United States Patent [19]

Shealy, Jr.

[11] 3,999,755

[45] Dec. 28, 1976

[54] FOOTBALL TRAINING DEVICE

[76] Inventor: Victor Dalmuth Shealy, Jr., 1208 Knotty Oaks Drive, Waco, Tex. 76710

[22] Filed: Mar. 27, 1975

[21] Appl. No.: 562,400

[52] U.S. Cl. ..... 273/55 R

[51] Int. Cl.[2] ..... A63B 67/00

[58] Field of Search ..... 273/55 R, 55 A; 272/76, 272/78

[56] References Cited

UNITED STATES PATENTS

| | | | |
|---|---|---|---|
| 1,231,251 | 6/1917 | Graham | 273/55 R |
| 2,752,155 | 6/1956 | Nedwick | 273/55 R |
| 2,967,709 | 1/1961 | Stahley | 273/55 R |
| 3,304,089 | 2/1967 | Smith | 273/55 R |
| 3,433,480 | 3/1969 | Coleman et al. | 273/55 R |
| 3,451,677 | 6/1969 | Nedwick | 273/55 R |
| 3,675,922 | 7/1972 | Nieland | 273/55 R |

*Primary Examiner*—Richard C. Pinkham
*Assistant Examiner*—T. Brown

[57] ABSTRACT

An athletic training device for training football players. The device comprises a pair of spaced opposed upper rails and a pair of spaced opposed lower rails defining a passsageway through which a football player can run. On each rail are mounted a plurality of ring-like resilient, resister members extending laterally inwardly toward each other to provide barriers to resist the movement of the player through the passageway. The arcuate resister members are comprised of automobile tires and are spaced in a horizontally extending, staggered relationship. The rails are supported by a framework. In addition, a boom element may be rigidly affixed to the frame, extending laterally outwardly thereof to provide a support for a suspended tackling dummy or the like.

13 Claims, 2 Drawing Figures

FOOTBALL TRAINING DEVICE

BACKGROUND OF THE INVENTION

1. Field of the Invention

The invention relates to athletic training devices and, more particularly, to a football training device employing resister members to inhibit the movement of a football player through a passageway.

2. Description of the Prior Art

In the athletic device art, it is well known to provide a football trainer wherein resistive members are disposed along a passageway to contact the football player during his traversal of the passageway. The function of these devices is to simulate contact by opposing players to improve the ability of a runner to avoid fumbles, and additionally to increase the runner's arm and leg strength.

Prior art training devices have not adequately simulated the contact of opposing players, and thus have not served to properly train the athlete as desired. The fault lies, to a great extent, in the positioning and the shape of the prior art resister elements. For example, many prior art resister elements are in the form of flat plates, either padded or unpadded. The plates usually are hinged, and their rotation on the hinges is resisted by spring-like members. Other types of resister elements are elongated, flexible cones, or other elongated flexible members in the form of bats or pins. In all cases, the elements are in spaced, opposed formation so as to form a passageway which is difficult to traverse. Unfortunately for the athlete, however, many prior art resistive elements impact the player with considerable force upon quite a small area, and this can cause injuries. Other resister elements simply slap against the runner, and their effect as a life-like drill is minimal. None of the prior art devices grab at the runner's limbs, and at the football, as an opposing player would do in a real-life situation.

Finally, all of the prior art devices utilize resister elements of special shapes, which must be specially manufactured. The initial costs and the replacement costs are thus high.

SUMMARY OF THE INVENTION

It is an object of this invention to provide a new and improved athletic training device for football players which effectively simulates a real-life situation.

A further object of this invention is to provide a new and improved athletic training device for football players which comprises resister elements which grasp at the runner's limbs and at the football.

Still another object of the invention is to provide an athletic training device having resister members which are easily and inexpensively obtained.

A further object of the invention is to provide a new and improved athletic training device utilizing resister members which minimize the chance of injuring the player.

In carrying out the above objectives, this invention comprises at least two rows of resilient resister members mounted in opposed relationship to one another, defining a passageway of predetermined width. Each resister member presents to the runner a ring-like, or arcuate, configuration generally perpendicular to the direction of the runner's movement. The rows of resister elements preferably arranged at such heights as will contact the runner as he moves through the passageway between his waist and his shoulders and/or at his knee or thigh level. Advantageously, the resister members are automobile tires or the like, mounted on opposed rails which are part of a larger framework. The opposed rails can be adjustable to vary the resistance the runner must move against.

The advantages of this device over the prior art are several. First, the shape of the resister elements causes a grasping or clutching at the runner, which tends to pull loose the football, and which retard the movement of his body and limbs in a very life-like manner. Should the runner extend a hand, it could go through the opening in the resister elements, and be grasped in the same manner as an opposing player would grasp it. Second, the particular shape of the resister elements results in contact with a relatively large area of the runner's body, minimizing the chances of bruises or other injuries. Third, the resister elements of this invention can be used automobile tires, which are inexpensive and easily found.

As an auxiliary, a boom can be attached to the frame at an appropriate point, from which a tackling dummy or the like can be suspended. This dummy can be used to simulate a defensive player closing on the ball-carrier, for example, or it can be placed at the end of the passageway to be tackled by the runner when he emerges from the passageway.

DESCRIPTION OF A PREFERRED EMBODIMENT

Figure 1:
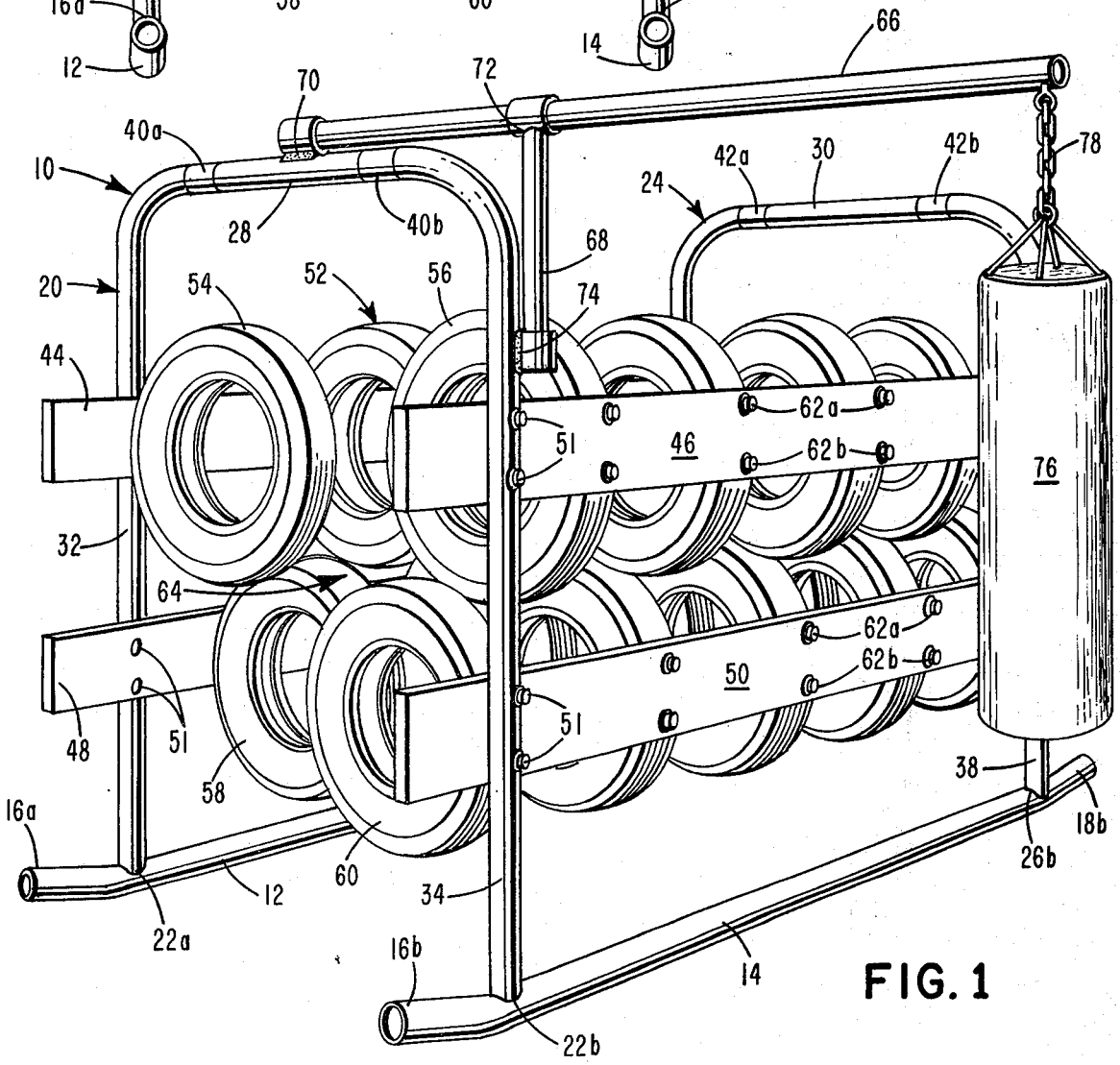
FIG. 1 is a perspective view of one embodiment of an athletic training device according to the invention.

An athletic training device 10 is shown in FIG. 1. The device comprises a pair of laterally spaced, elongated skids 12 and 14, which are comprised of steel tubing or pipe, or any other suitable structural material. In order to facilitate movement of the device, each skid is turned upwardly at each end, as at 16*a*, 16*b*, 18*a* and 18*b*.

An inverted, U-shaped front frame element 20 is rigidly affixed to skids 12 and 14 proximate one end thereof. Front frame element 20 is disposed approximately perpendicular to skids 12 and 14 and is attached as by welds at 22*a* and 22*b*. An inverted rear U-shaped frame element 24, is substantially identical to frame element 20, proximate the other end of the skids from frame element 20. Rear frame element 24 is rigidly affixed to the skids as by welds at 26*a* and 26*b*. Frame elements 20 and 24 preferably are of steel tubing or pipe. Frame elements 20 and 24 comprise upper beam portions 28, 30 and uprights 32, 34, 36 and 38. The heights of uprights 32–38 and the length of beam portions 28 and 30 are appropriately selected so as to permit the passage of an athlete therethrough. It will be noted that by selecting an appropriate length of beam portions 28 and 30, the width of the device may be controlled as desired. To this end, beam portion 28 is provided with a pair of couplings 40*a* and 40*b*, and beam portion 30 is provided with a pair of couplings 42*a* and 42*b*. By utilizing the couplings, beam portions 28 and 30 may be removed easily and replaced by beam portions of a different length, thus permitting the width of the device to be changed easily.

Connecting the uprights of each frame element 20 and 24 is a pair of upper rail members 44 and 46. Similarly, the uprights of each frame member 20 and 24 are connected by a pair of lower rail members 48 and 50. A plurality of bolted fasteners 51, two per rail, are employed to rigidly affix rail members 44–50 to uprights 32–38. Rail members 44–50 can be comprised of wood, but they can be of other structural material.

Figure 2:
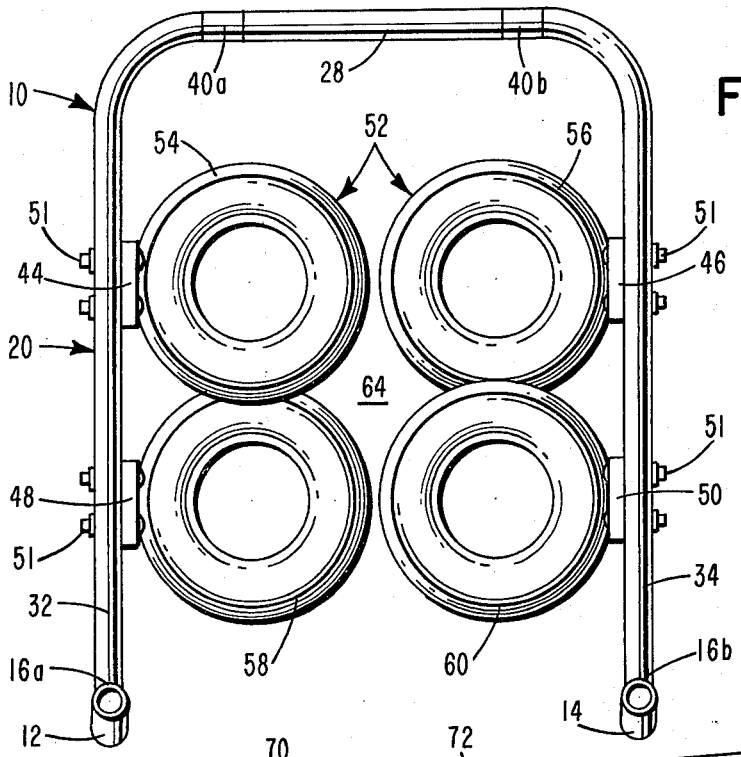
FIG. 2 is an end view of the device of FIG. 1.

Each of the rails 44–50 supports a plurality of resilient, resister members 54,56,58 and 60, which present an arcuate open-centered configuration to the center portion of the passageway. Resistor members 52 are best illustrated as automobile tires, but they could also be segments of an automobile tire, or they could be other ring-like elements of similar shape. All of the resister members are substantially identical, but for purposes of illustration, they are grouped as 54,56,58 and 60, corresponding to upper and lower rail members 44,46,48 and 50, as best shown in FIG. 2. Resister members 54 and 56 extend toward each other in a horizontally opposed, staggered relationship. Each resister member is rigidly affixed to a rail member by pair of bolted fasteners 62*a* and 62*b*. The bolted fasteners employed to affix the resister members to the rail members may be substantially identical and comprised of any well known material and formed in any well known shape so long as the resister members are rigidly affixed to the rail members. In a manner similar to resistor members 54 and 56, resister members 58 and 60 are rigidly affixed to lower rail members 48 and 50 by a pair of bolted fasteners 62*a* and 62*b* and extend toward each other in a horizontally opposed, staggered relationship. By this construction, a passageway, or tunnel 64 is defined, which passageway 64 longitudinally extends between frame elements 20 and 24.

While one means of varying the width of the tunnel is described above, another means would be providing adjustable mountings (not shown) for rails 44,46,48 and 50 to frame elements 20 and 24.

An attachment to the basic device is illustrated in FIG. 1. A boom element 66 is rigidly affixed to upright 36 and beam portion 28 of frame element 20 and extends laterally outwardly thereof. A vertical support 68 connects boom element 66 and upright 36. In order to insure rigidity of the structure, welded connections are made as at 70,72 and 74.

A tackling dummy 76 is suspended by a chain or cable 78 from that end of boom element 66 distal upright 36. If desired, cable 78 could be suspended from boom element 66 at any point therealong. Boom element 66 can be attached by pivot means (not illustrated) at 70, if desired, to allow the dummy's position relative to the end of the tunnel to be varied.

By employing rounded skids 12 and 14, the device may be moved rapidly into position on a practice field with minimal damage to the playing surface. By employing skids of such construction, it will be possible for only two or three players to move the device about a playing field, even though the device is quite large. Significant advantages are thus realized through the elimination of trucks or tractors to move the device.

While a specific embodiment of the invention has been described, it will be obvious to those skilled in the art that changes and modifications may be made without departing from the invention. It is therefore intended to the appended claims to cover all such changes and modifications that fall within the true spirit and scope of the invention.

I claim:

1. An athletic training device comprising:

frame means, first and second rails carried by said frame means, said first and second rails being in spaced opposed relationship to one another to define a passageway therebetween.

a plurality of first resister elements mounted on each of said first and second rails and extending laterally inwardly of said passageway to resist the movement of a person through said passageway, each of said first resister elements comprising at least a portion of a ring defining at least a portion of a central opening.

2. The athletic training device of claim 1 wherein said first resister elements mounted on said first rail are in staggered relationship to said first resistor elements mounted on said second rail.

3. The athletic training device of claim 1 further comprising third and fourth rails carried by said frame means at a height below that of said first and second rails, said third and fourth rails being in spaced opposed relationship to one another to further define said passageway, and a plurality of second resilient resister elements mounted on each of said third and fourth rails and extending laterally inwardly of said passageway to further resist the movement of a person through said passageway.

4. An athletic training device of claim 3 wherein said first resister elements mounted on said first rail are staggered with respect to said first resister elements mounted on said second rail, and wherein said second resister elements mounted on said third rail are in staggered relationship with respect to said second resister elements mounted on said fourth rail.

5. The athletic training device of claim 4 wherein said rails are substantially horizontal.

6. The athletic training device of claim 3 wherein each of said second resister elements comprises at least a portion of a ring.

7. The athletic training device of claim 6 wherein each of said first resister elements and each of said second resister elements comprises a ring.

8. The athletic training device of claim 1 wherein each of first said resister elements comprises a ring.

9. The athletic training device of claim 8 wherein each of first said resister elements is a vehicle tire.

10. The athletic training device of claim 1 wherein said frame means comprises a first pair of upright posts supporting said first rail, a second pair of upright posts supporting said second rail, and first and second beams spanning said passageway, said first beam connecting together one of said first upright posts and one of said second upright posts, and said second beam connecting together the other of said first upright posts and the other of said second upright posts.

11. The athletic training device of claim 10 further comprising means for altering the length of said first and second beams to thereby vary the width of said passageway.

12. The athletic training device of claim 10 further comprising first skid means upon which said first upright posts are mounted and second skid means upon which said second upright posts are mounted.

13. The athletic training device of claim 1 further comprising a boom element mounted on said frame means and extending outwardly therefrom, and a tackling dummy suspended from said boom means.

* * * * *